US009682421B2

(12) United States Patent
Kanahashi et al.

(10) Patent No.: US 9,682,421 B2
(45) Date of Patent: Jun. 20, 2017

(54) TITANIUM CONTINUOUS CASTING DEVICE

(71) Applicant: Kabushiki Kaisha Kobe Seiko Sho (Kobe Steel, Ltd.), Kobe-shi (JP)

(72) Inventors: Hidetaka Kanahashi, Takasago (JP); Hideto Oyama, Takasago (JP); Takehiro Nakaoka, Kobe (JP); Eisuke Kurosawa, Kobe (JP); Kazuyuki Tsutsumi, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 105 days.

(21) Appl. No.: 14/648,794

(22) PCT Filed: Dec. 17, 2013

(86) PCT No.: PCT/JP2013/007419
§ 371 (c)(1),
(2) Date: Jun. 1, 2015

(87) PCT Pub. No.: WO2014/103245
PCT Pub. Date: Jul. 3, 2014

(65) Prior Publication Data

US 2015/0343521 A1 Dec. 3, 2015

(30) Foreign Application Priority Data

Dec. 28, 2012 (JP) ..... 2012-287368

(51) Int. Cl.
*B22D 11/041* (2006.01)
*B22D 11/11* (2006.01)
(Continued)

(52) U.S. Cl.
CPC ..... *B22D 11/001* (2013.01); *B22D 7/005* (2013.01); *B22D 11/041* (2013.01); *B22D 11/10* (2013.01);
(Continued)

(58) Field of Classification Search
CPC ..... B22D 11/001; B22D 11/041; B22D 11/10; B22D 11/11; B22D 21/005; B22D 27/06
See application file for complete search history.

(56) References Cited

U.S. PATENT DOCUMENTS 3,894,573 A * 7/1975 Paton ..... H05B 7/00 164/469
2002/0179278 A1 12/2002 Spadafora et al.
2004/0056394 A1 3/2004 Jackson et al.

FOREIGN PATENT DOCUMENTS

JP 46 4356 11/1971
JP 63 157739 6/1988
(Continued)

OTHER PUBLICATIONS

International Search Report and Written Opinion of the International Searching Authority Issued Mar. 18, 2014 in PCT/JP2013/007419 Filed Dec. 17, 2013.

*Primary Examiner* — Kevin E Yoon
(74) *Attorney, Agent, or Firm* — Oblon, McClelland, Maier & Neustadt, L.L.P.

(57) ABSTRACT

Provided is a device for titanium continuous casting (1) capable, even when continuously casting large diameter titanium ingots or titanium alloy ingots, of suppressing component segregation thereof. The device for titanium continuous casting (1) comprises: a mold (3) having an upper section having a circular upper opening (3*a*) for pouring in molten metal (6), and a bottom section having a lower opening for continuously drawing ingots (11); and a plurality of plasma torches (4, 5) to heat the molten metal in the mold (3) from the upper opening (3*a*) side. The plurality of plasma torches (4, 5) are disposed so that the amount of heat input to the molten metal (6) present in the outer circumference enclosing the center of the upper opening
(Continued)

(3*a*) is greater than the amount of heat input to the molten metal (6) present in the center of the upper opening (3*a*).

9 Claims, 5 Drawing Sheets

(51) Int. Cl.

| | |
|---|---|
| ***B22D 11/00*** | (2006.01) |
| ***B22D 11/10*** | (2006.01) |
| ***B22D 21/00*** | (2006.01) |
| ***B22D 27/06*** | (2006.01) |
| ***B22D 7/00*** | (2006.01) |

(52) U.S. Cl.
CPC ..... *B22D 11/11* (2013.01); *B22D 21/005* (2013.01); *B22D 27/06* (2013.01)

(56) References Cited

FOREIGN PATENT DOCUMENTS

| | | |
|---|---|---|
| JP | 2000 274957 | 10/2000 |
| JP | 2009 172665 | 8/2009 |
| WO | 2005 025774 | 3/2005 |

* cited by examiner

TITANIUM CONTINUOUS CASTING DEVICE

TECHNICAL FIELD

The present invention relates to a titanium continuous casting device which casts a columnar ingot of titanium or a titanium alloy with continuously withdrawing the ingot.

BACKGROUND ART

Pure titanium and titanium alloy are metal materials which are indispensable in chemical/electrical plants or in high-value-added products such as airplane, sports equipment, for having an excellent lightness, thermal resistance and corrosion resistance. Titanium metal products which are produced from such pure titanium and titanium alloy are manufactured through processes of rolling or forging to a titanium ingot. As a technique of producing a titanium ingot, there are Consumable Electrode Vacuum Arc Remelting VAR (Vacuum Arc Remelting) method, Hearth Melting EB (Electron Beam) method which uses electron beam, Hearth Melting PAM (Plasma Arc Melting) method which uses plasma arc, which will be explained below.

The Consumable Electrode Vacuum Arc Remelting VAR method is a technique which has been conventionally widely used as a method of melting a titanium ingot comprising pure titanium or a titanium alloy. The VAR method is a method in which an arc (DC arc) is generated in a melting furnace in an atmosphere of high vacuum or an inert gas (Ar, He) between a consumable electrode which is prepared in advance by using a raw material of titanium ingot and a molten metal in a water-cooled copper crucible, and the consumable electrode is melted by using the arc as a heat source, to thereby obtain a titanium ingot from the molten metal of the melted consumable electrode.

In the VAR method, in order to completely melt the raw material of the titanium ingot to homogenize chemical composition of the titanium ingot, usually, a second melting is performed by using the titanium ingot obtained in the first melting as a consumable electrode. In particular, in titanium alloys for aircraft use, the melting is sometimes performed for three times for further homogenization of chemical composition of titanium ingot to reduce segregation of chemical composition.

Hearth melting EB method is a technique of producing a titanium ingot by supplying raw materials comprising melted titanium sponge, scrap or the like to a water-cooled copper hearth, heating these raw materials by using electron beam as a heat source, pouring the heated material continuously into a water-cooled copper mold, and then continuously withdrawing the material from the mold. In this EB method, the withdrawal is performed with irradiating surface of the molten metal with electron beams in order to maintain uniformity of the molten metal temperature in the water-cooled copper mold and to suppress coagulation, in a high vacuum environment. In this time, by the irradiation with electron beams having a high energy density in a high vacuum environment, a metal with a low melting point such as Al having a high vapor pressure is evaporated, and therefore, it is difficult to control chemical composition of the materials. Therefore, it can be said that this EB method is a preferred technique mainly for production of pure titanium ingot.

Hearth melting PAM method is a technique for producing a titanium ingot by supplying raw materials comprising melted titanium sponge, scrap or the like to a water-cooled copper hearth, heating these raw materials by using plasma arc as a heat source, pouring the heated material continuously into a water-cooled copper mold, and then continuously withdrawing the material from the mold. In this PAM method, the withdrawal is performed with irradiating surface of the molten metal with an arc generated from a plasma torch in an inert gas environment. It can be said that PAM method is a preferred technique for production of ingot of titanium alloy, since it is carried out in an inert gas environment, the evaporation loss of the molten metal is relatively small, and the chemical composition control of the raw material is relatively easy.

Both the EB method and the PAM method are capable of producing a titanium ingot directly from raw materials, without need of preparing a consumable electrode as in the VAR method, and therefore, have attracted more attention as a melting method with higher productivity than that of the VAR method.

Patent Document 1 discloses a method for producing a metal ingot with a high melting point by performing withdrawing with irradiating surface of a molten metal with electron beam, which is an example of the EB method. The method for producing a metal ingot with a high melting point of Patent Document 1 is a method in which, while molten metal is supplied into a mold which constitutes an electron beam-melting furnace to form a mold pool, a cooled and solidified ingot part near the bottom of the mold pool is withdrawn with being turned to thereby produce a metal ingot with a high melting point, and in which the mold pool surface is irradiated such that energy density of the electron beams along the outer circumferential portion of the mold pool adjacent to the mold is enhanced relative to electron beams in the central portion of the mold pool among the electron beams with which the mold pool surface is irradiated.

As described above, the EB method employed in the technique of Patent Document 1 is a melting method of higher productivity than VAR method is, for being capable of producing a titanium ingot directly from raw material. However, due to use of electron beams, the method should to be carried out in a high vacuum environment, and therefore, is not suitable for producing ingot of titanium alloy which requires chemical composition control of the raw material.

Therefore in these days, hearth melting, in particular, a PAM method which has small evaporation loss is beginning to be recommended as a means of producing a titanium alloy ingot of homogeneous chemical composition with no internal defect. However, in the conventional PAM method, in producing an ingot of small segregation of chemical composition, there has been a limit in diameter of the ingot, and therefore, it has been difficult to suppress segregation of chemical composition in the titanium alloy to produce a high-quality ingot.

Specifically, in a casting method which uses the PAM method in which melted titanium alloy is poured into a mold and simultaneously the molten metal in the mold is downwardly withdrawn with being heated with plasma torch, heating the central portion of upper surface of the molten metal by plasma forms a molten metal pool in which the central portion is the most deep. The molten metal pool is a solidification interface position of molten metal. When diameter of a mold is increased in order to increase diameter of a titanium ingot to be withdrawn, the central portion of a molten metal pool becomes too deep, and segregation of chemical composition becomes noticeable.

It is said that limit of diameter for a titanium ingot to have an insignificant segregation of chemical composition is conventionally ϕ300 to 400 mm. As for a titanium alloy ingot, it is said to be ϕ900 mm (3 times melting) at maximum in the VAR method, and about ϕ500 mm at maximum in the PAM method. However, in order to obtain a product with an excellent mechanical characteristic such as fatigue strength by processing an ingot through a forging process and heat treatment to form a homogenous material construction, an ingot of a large diameter of ϕ800 mm or more, preferably, ϕ1,000 mm or more is required. Therefore, there has been desired a casting method capable of controlling segregation of chemical composition even in a titanium ingot and titanium alloy ingot with a large diameter to become equivalent to or less than a segregation of chemical composition in an ingot with a small diameter.

CITATION LIST

Patent Document

Patent Document 1: JP 2009-172665 A

SUMMARY OF THE INVENTION

Object of the present invention is to provide a titanium continuous casting device capable of suppressing a segregation of chemical composition of the ingot, even in the case of continuous casting of a large diameter titanium ingot or a titanium alloy ingot.

The first titanium continuous casting device provided by the present invention comprises a mold which comprises an upper section comprising a circular upper opening for pouring in molten metal of titanium or a titanium alloy, and a bottom section comprising a lower opening for continuously withdrawing ingot of the titanium or the titanium alloy; a first and a second plasma arc irradiation unit each being disposed so as to face to the upper opening of the mold and to irradiate the upper opening of the mold with plasma arc; and a driving device which rotates at least the second plasma arc irradiation unit around the center of the upper opening of the mold. The first plasma arc irradiation unit is disposed nearer to the center of the upper opening than the second plasma arc irradiation unit is disposed.

The second titanium continuous casting device provided by the present invention comprises a mold which comprises an upper section comprising a circular upper opening for pouring in molten metal of titanium or a titanium alloy, and a bottom section comprising a lower opening for continuously withdrawing ingot of the titanium or the titanium alloy; and a plural plasma torches which heat molten metal in the mold from side of the upper opening of the mold by using plasma arc. The plural plasma torches are disposed such that heat input amount to the molten metal present in the outer circumferential portion surrounding the central portion of the upper opening is larger than heat input amount to the molten metal present in the central portion of the upper opening.

DESCRIPTION OF EMBODIMENTS

Hereinafter, an embodiment of the present invention will be explained with reference to the drawings. In this connection, the embodiment which will be explained below is an example of actualizations of the present invention, and the structure of the present invention is not limited to the specific example. Thus, the technical scope of the present invention is not limited to the disclosure of the present embodiment.

A titanium continuous casting device 1 according to the present embodiment will be explained with reference to FIG. 1. As used in the following explanation, the direction of gravity is referred to as downward direction, and the opposite direction is referred to as upward direction.

Figure 1:
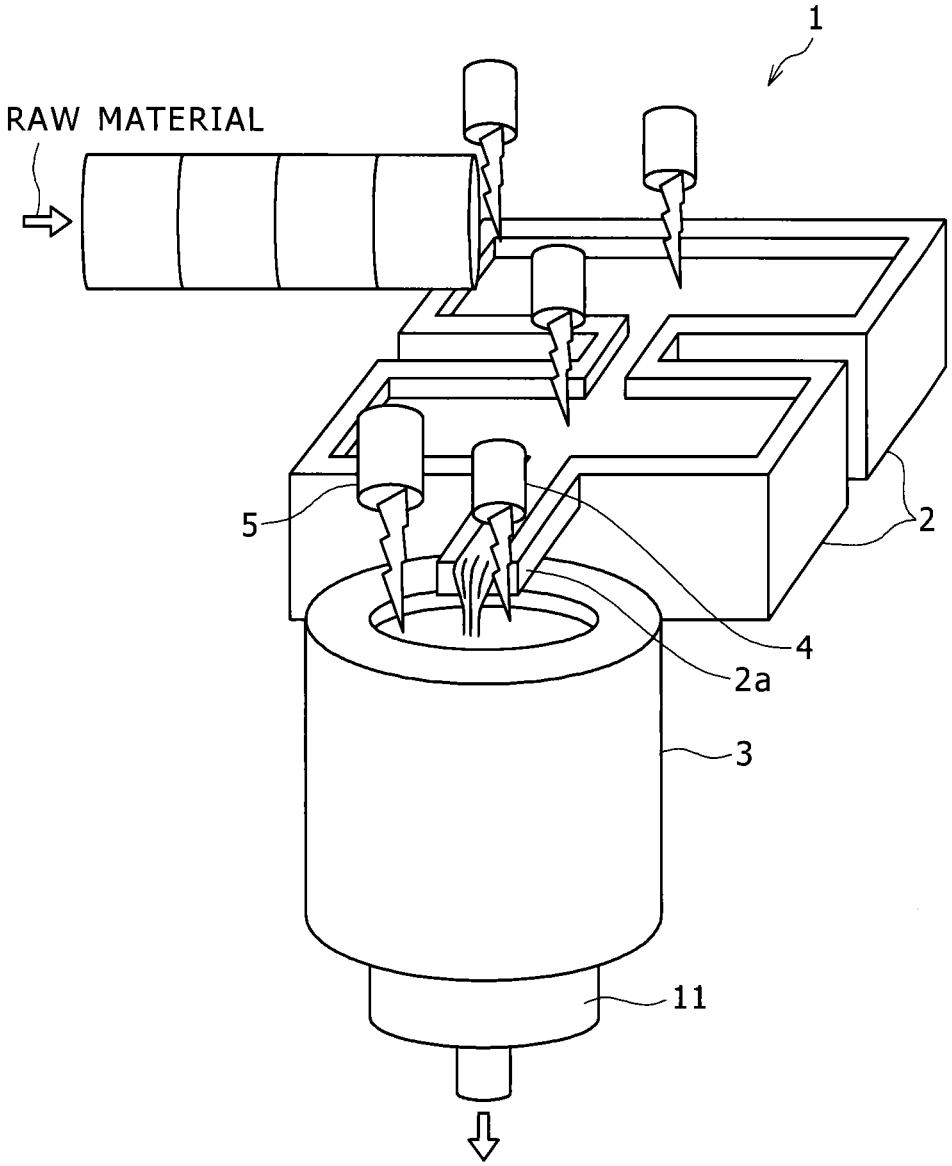
FIG. 1 is a perspective view showing the titanium continuous casting device according to an embodiment of the present invention.

FIG. 1 shows the titanium continuous casting device 1 according to the present embodiment. The titanium continuous casting device 1 is a device capable of producing an ingot of titanium and an ingot of a titanium alloy. However, in the present embodiment, a case of producing ingot of titanium alloy will be explained.

As shown in FIG. 1, the titanium continuous casting device 1 comprises a water-cooled copper hearth 2, a water-cooled copper mold 3, and plural heating torches.

The water-cooled copper hearth 2 is to store melted titanium alloy as a raw material for titanium alloy ingot (hereinafter referred to as melted titanium alloy or molten metal), and has a shape of box. The mold for water-cooling 3 corresponds to the mold according to the present invention. Into the mold for water-cooling 3, the melted titanium alloy is poured from the water-cooled copper hearth 2, and a titanium alloy ingot 11 is withdrawn downwardly from the mold for water-cooling 3. The plural heating torches are to heat the melted titanium alloy poured into the water-cooled copper mold 3, one of the characteristic thereof being individually comprising a central portion heating torch 4 which heats the central portion and an outer circumferential portion heating torch 5 which heats outer circumferential portion of the melt surface of molten metal surface of the melted titanium alloy.

Hereinafter, structure of the titanium continuous casting device 1 will be explained in detail.

As shown in FIG. 1, the water-cooled copper hearth 2 is a copper container having a shape, for example, similar to a box-type water tank, and inner wall of the container is made of copper. Inside the copper wall, water cooling mechanism is provided to prevent damage to the water-cooled copper hearth 2 due to heat of the poured high temperature melted titanium alloy. Furthermore, the water-cooled copper hearth 2 comprises a discharge port 2*a* for discharging the melted titanium alloy in the water-cooled copper hearth 2 at a predetermined flow rate. The melted titanium alloy poured and once stored in the water-cooled copper hearth 2 is poured from the discharge port 2*a* to the water-cooled copper mold 3. The plural heating torches are provided above the water-cooled copper hearth 2, and heat the melted titanium alloy by using plasma arc so that the melted titanium alloy stored in the water-cooled copper hearth 2 does not coagulate due to lowered temperature thereof.

Next, structures of the water-cooled copper mold 3, the central portion heating torch 4, and the outer circumferential portion heating torch 5 will be explained with reference to FIG. 2A and FIG. 2B. The central portion heating torch 4 is a first heating torch provided above the water-cooled copper mold 3, and the outer circumferential portion heating torch 5 is a second heating torch also provided above the water-cooled copper mold 3.

Figure 2A:
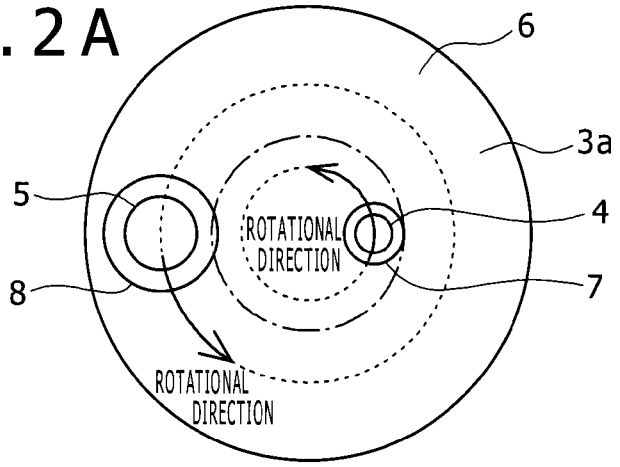
FIG. 2A is a plan view showing a water-cooled copper mold, a central portion heating torch, and an outer circumferential portion heating torch in the titanium continuous casting device according to the present invention.
Figure 2B:
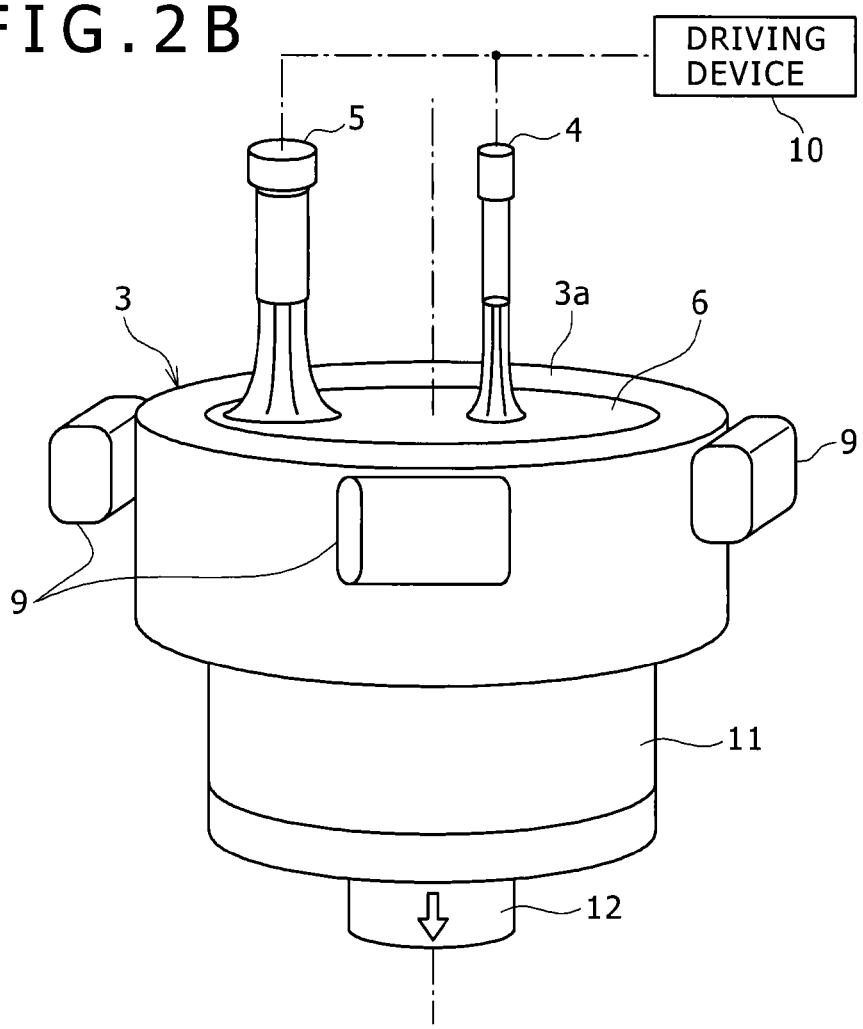
FIG. 2B is a sectional view showing the water-cooled copper mold, the central portion heating torch, and the outer circumferential portion heating torch in the titanium continuous casting device according to the present invention.

FIG. 2A and FIG. 2B show an arrangement of the water-cooled copper mold 3, the central portion heating torch 4, and the outer circumferential portion heating torch 5. FIG. 2A is a plan view showing an arrangement of a melt surface 6 of the melted titanium alloy, the central portion heating torch 4 and the outer circumferential portion heating torch 5 facing the melt surface 6 when the water-cooled copper mold 3 is viewed from above; and FIG. 2B is a perspective view showing an arrangement of the water-cooled copper mold 3, the central portion heating torch 4, and the outer circumferential portion heating torch 5.

As shown in FIG. 2B, the water-cooled copper mold 3 has a shape similar to a trough with an appearance of a cylindrical shape. The water-cooled copper mold 3 has an inner circumferential surface which surrounds a through hole, and the inner circumferential surface has a tapered shape, specifically a shape in which the diameter thereof decreases along the axis of the water-cooled copper mold 3 of a columnar shape, through one end to the other end to form a substantially truncated cone shape, the end of the side of larger diameter of the through hole constituting an upper opening 3*a* of the water-cooled copper mold 3. The water-cooled copper hearth 3 has a copper inner wall as the water-cooled copper hearth 2. Inside the copper inner wall, a water cooling mechanism is provided to prevent damage to the inner wall due to the heat of the poured melted titanium alloy having a high temperature.

The water-cooled copper mold 3 is arranged below the discharge port 2*a* of the water-cooled copper hearth 2. Specifically, the upper opening 3*a*, namely, the opening at the side of the larger diameter of the openings which constitute the ends of the through-hole is positioned below the discharge port 2*a*. Water-cooled copper mold 3 has a bottom section which surrounds the lower opening having the smaller diameter of the through-hole of the openings. The bottom section is provided with a withdrawal device 12 for withdrawing a melted titanium alloy which was poured from the water-cooled copper hearth 2 into the mold for water-cooling 3 as the titanium alloy ingot 11, from the mold for water-cooling 3. Taper angle of the through-hole and of the inner circumferential surface surrounding the through-hole is set so as to be capable of accommodating solidification shrinkage of the titanium ingot or titanium alloy ingot which varies depending on speed of withdrawing. The shape of the inner circumferential surface does not necessarily have to be a tapered shape, as long as the shape is capable of preventing a gap which may occur between the water-cooled copper mold and the ingot due to the solidification shrinkage.

The titanium continuous casting device 1 further comprises plural electromagnetic stirring devices 9. These electromagnetic stirring devices 9 are provided along an outer wall surface of the mold for water-cooling 3, and applies magnetic field to the melted titanium alloy poured into the mold for water-cooling 3 from the peripheral side thereof, to thereby circulate and stir the outer circumferential portion of the melted titanium alloy. Use of the electromagnetic stirring devices 9 allows obtaining an effect of varying the flow state of the melted titanium alloy to make temperature of the melted titanium alloy to be in a higher range and uniform, and makes it possible to vary the shape of the molten metal pool which is a solidification interface position of the melted titanium alloy.

The central portion heating torch 4 which is the first heating torch is a torch for generating plasma arc, and disposed above the central portion of the upper opening 3*a* of the water-cooled copper mold 3. In this embodiment, it is disposed in a position off the center of the upper opening of the mold 3 when the titanium continuous casting device is viewed from the side of the upper opening 3*a* of the mold 3. Thus, the central portion heating torch 4 is disposed above a region present in the central portion of the upper opening 3*a* of the melt surface 6 of the melted titanium alloy which is poured into the water-cooled copper mold 3, and heat the central portion of the melt surface 6 of the melted titanium alloy from above, by irradiating the melt surface 6 of the melted titanium alloy with the generated plasma arc.

The outer circumferential portion heating torch 5 which is the second heating torch also is a torch for generating plasma arc, and disposed above the outer circumferential portion surrounding the central portion within the upper opening of the water-cooled copper mold 3. Thus, the outer circumferential portion heating torch 5 is disposed above a region present in the outer circumferential portion of the upper opening 3*a* of the melt surface 6 of the melted titanium alloy which is poured into the water-cooled copper mold 3, and heat the outer circumferential portion of the melt surface 6 of the melted titanium alloy from above, by irradiating the melt surface 6 of the melted titanium alloy with the generated plasma arc.

Next, with reference to FIG. 2B which shows the melt surface 6 of the melted titanium alloy, the central portion and the outer circumferential portion of the upper opening 3*a* and the melt surface 6 will be defined, and an arrangement of the central portion heating torch 4 and the outer circumferential portion heating torch 5 will be explained. The melt surface 6 of the melted titanium alloy has a circular shape substantially congruent with the upper opening 3*a* of the water-cooled copper mold 3. In the following explanation, r represents radius of the upper opening 3*a*.

Definitions of the central portion and the outer circumferential portion of the upper opening and the melt surface according to the present invention are relative. The central portion in the opening part of the water-cooled copper mold 3 which is a mold may be defined as a surface portion of the molten metal in a region within radius r/3 r/3 from the center of the upper opening 3*a* and the melt surface 6. In that case, the outer circumferential portion is defined as a surface portion of the molten metal in a region within radius r/3 to r. It is also possible to define a region within radius r/2 from the center of the circular upper opening 3*a* and the melt surface 6 as the central portion, and a region within radius r/2 to r surrounding the central portion as the outer circumferential portion.

Under such definition of the central portion and the outer circumferential portion, the central portion heating torch 4 is provided above the central portion of the upper opening 3*a*, and the central portion of the melt surface 6 is irradiated with plasma arc from above the water-cooled copper mold 3. The outer circumferential portion heating torch 5 is provided above the outer circumferential portion of the upper opening 3*a*, and the outer circumferential portion of the melt surface 6 is irradiated with plasma arc from above the water-cooled copper mold 3.

As shown in FIG. 2A, the plasma-irradiated position by the central portion heating torch 4 and the plasma-irradiated position by the outer circumferential portion heating torch 5 facing the melt surface 6 are preferably aligned on the same straight line passing the center of the upper opening 3*a* and the melt surface 6. Moreover, they are preferably disposed in substantially opposite positions to each other sandwiching the center along direction of diameter of the upper opening 3*a* and the melt surface 6. FIG. 2A shows a central portion torch-effecting range 7 and an outer circumferential portion torch-effecting range 8. The central portion torch-effecting range 7 is a region where the melt surface 6 is directly heated by the plasma arc extending from the central portion heating torch 4, which overlaps with a part of the central portion. The outer circumferential portion torch-effecting range 8 is a region where the melt surface 6 is directly heated by the plasma arc extending from the outer circumferential portion heating torch 5, which overlaps with a part of the outer circumferential portion. As can be seen from FIG. 2A and FIG. 2B, area of the central portion torch-effecting range 7 is smaller than total area of the central portion, and area of the outer circumferential portion torch-effecting range 8 is smaller than total area of the outer circumferential portion.

Therefore, the present embodiment further comprises a driving device 10 as shown in FIG. 2B. The driving device 10 rotates the central portion heating torch 4 and the outer circumferential portion heating torch 5 in a same direction around the center of the melt surface 6, with maintaining the relative positional relationship shown in FIG. 2A, to thereby pass the central portion torch-effecting range 7 through substantially the entire area of the central portion of the melt surface 6 in the central portion of the upper opening 3*a*, and to pass the outer circumferential portion torch-effecting range 8 through substantially the entire area of the outer circumferential portion of the melt surface 6 in the outer circumferential portion of the upper opening 3*a*. Concrete structure of the driving device 10 is not limited. The driving device 10 may be configured to comprise, for example, two arms having lengths different from each other, and a motor which rotates the arms. In that case, the shorter arm of the two arms is connected to the motor and to the central portion heating torch 4, and the longer arm is connected to the motor and to the outer circumferential portion heating torch 5. The motor drives the two arms to rotate simultaneously to thereby rotate both the central portion heating torch 4 and the outer circumferential portion heating torch 5.

By the rotation of both the heating torches 4 and 5 driven by the driving device 10, substantially the entire surface of the melt surface 6 is covered by the passage region of the central portion torch-effecting range 7 and the passage region of the outer circumferential portion torch-effecting range 8, and consequently, it is possible to surely heat the entire surface of the molten metal, namely, the entire of the melt surface 6. That is, the present embodiment achieves a soaking heating of a molten metal by the rotation of the each heating torch 4 and 5 as described above. Rotational direction of the each heating torch 4 and 5 should only be the same with each other and may be either clockwise or counterclockwise. In a case where the central portion heating torch 4 is disposed so as to be overlap with the center of the upper opening of the mold 3 when the titanium continuous casting device is viewed from the side of the upper opening of the mold 3, the driving device 10 may rotate only the outer circumferential portion heating torch 5 of the both heating torches 4 and 5.

It is further possible to control heating of the melted titanium alloy by making a voltage applied to the outer peripheral heating torch 5 larger than a voltage applied to the central portion heating torch 4, to thereby make a plasma arc output of the outer circumferential portion heating torch 5 larger than a plasma arc output of the central portion heating torch 4, to make a quantity of heat input to the outer circumferential portion of the molten metal larger than a quantity of heat input to the central portion of the molten metal.

For example, it is possible to set outputs of the central portion heating torch 4 and the outer circumferential portion heating torch 5 such that the quantity of heat input to the molten metal in a region within radius r/3 to r becomes larger than the quantity of heat input to the molten metal in a region within radius r/3 from the center of the upper opening 3*a* and the melt surface 6.

Below is a discussion on segregation of chemical composition which occurs when titanium alloy ingot 11 is produced by using the titanium continuous casting device 1 according to the present embodiment, with reference to FIG. 3 to FIG. 6. In this connection, FIG. 3 to FIG. 6 show results of computer simulations of behaviors of the melted titanium alloy (molten metal) in the water-cooled copper mold 3 of the present embodiment.

Figure 3:
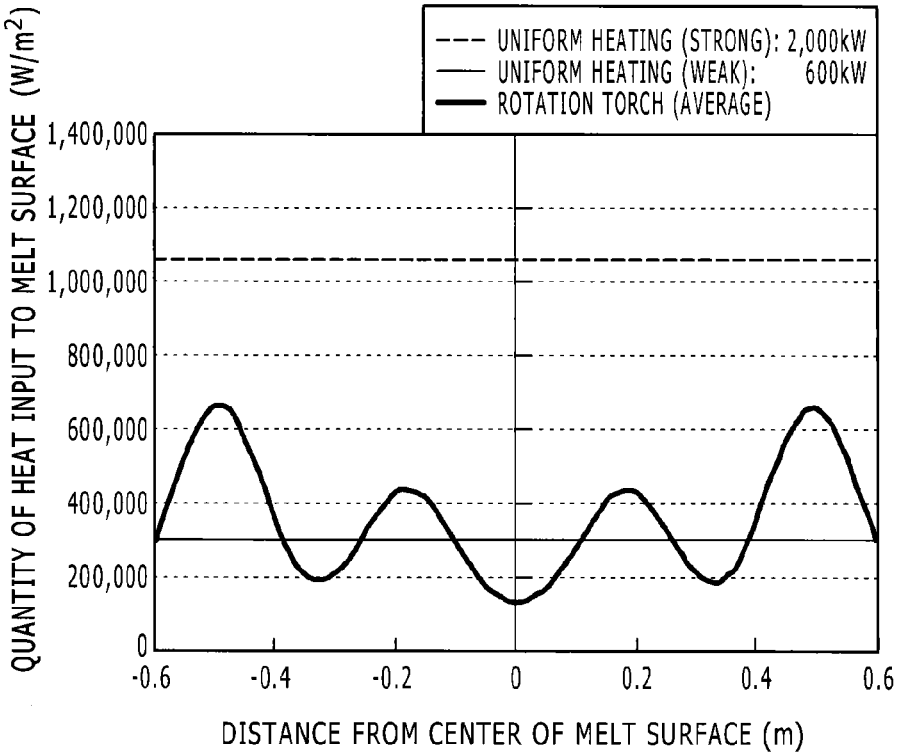
FIG. 3 is a graph showing a distribution of the heat input amount to the molten metal according to a comparative example in which a uniform heating is performed, and a distribution of the heat input amount to the molten metal according to the present embodiment.
Figure 4:
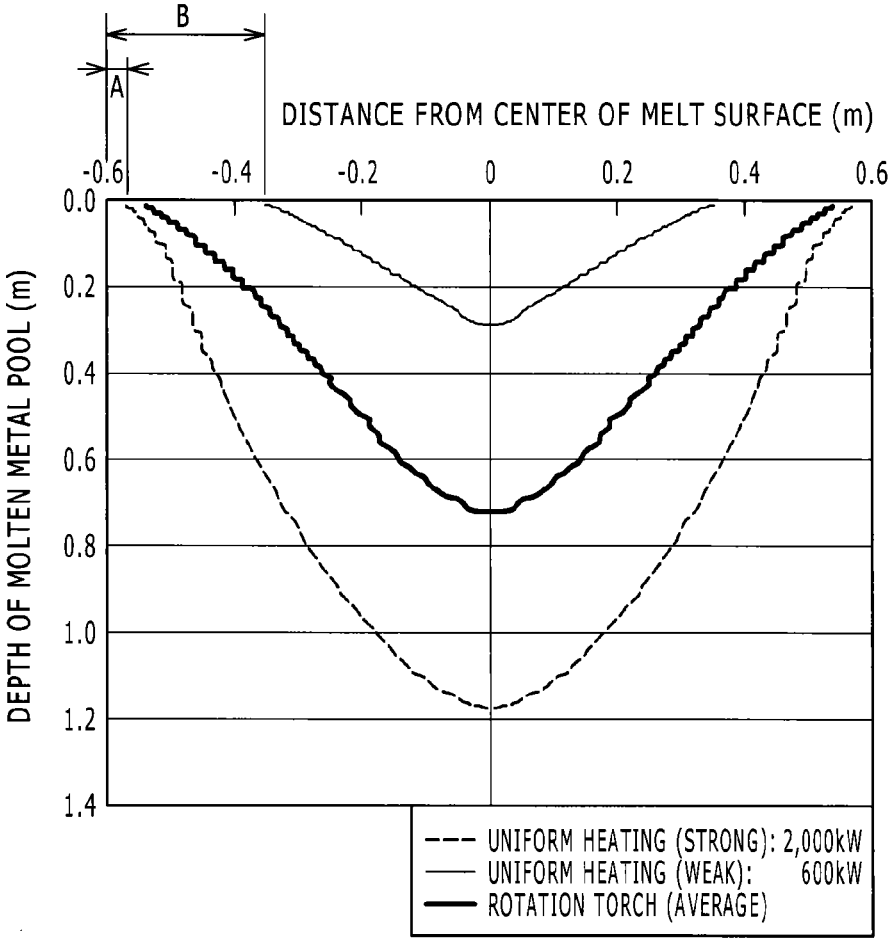
FIG. 4 is a graph showing a configuration of the molten metal pool in the comparative example in which a uniform heating is performed, and a configuration of the molten metal pool in the present embodiment.

First, in FIG. 3 and FIG. 4, the graphs shown as "uniform heating (strong)", and "uniform heating (weak)" represent molten metal beatings according to comparative examples, and the graph shown as "rotation torch" represents a method according to the present embodiment. The water-cooled copper mold 3 of the present embodiment comprises plural plasma torches disposed above the upper opening 3*a* thereof, the plural plasma torches being disposed along the radial direction of the upper opening 3*a* and the melt surface 6 which rotate around the center of the upper opening 3*a* and the melt surface 6. Outputs of the plural plasma torches to be rotated are set such that a quantity of heat input to the molten metal present in the outer circumferential portion surrounding the central portion of the upper opening 3*a* becomes larger than a quantity of heat input to the molten metal present in the central portion of the upper opening 3*a*.

FIG. 4 shows a result of examining distribution of melt pool depth, targeting a titanium ingot having a large diameter (for example, of $\phi$1,200 mm) taking its heat transfer and solidification into consideration. According to FIG. 4, in order for the entire surface of molten metal to be kept in a molten state by a uniform heating of 2,000 kW performed on the molten metal from upper surface of the mold as in the comparative example, input heat amount of 1.06 $MW/m^2$ per unit area is required with respect to the surface area. In other words, when the uniform heating to the molten metal is 2,000 kW or more, a coagulated surface exposure distance A at the time is small as shown in FIG. 4, which means that the molten metal presents in a molten state in the vicinity of the periphery of the opening of the water-cooled copper mold 3. However, depth of the molten metal pool becomes very deep, where possibility of occurrence of the segregation of chemical composition is high. It is clear from FIG. 6 that the larger the depth of the molten metal pool is, the more significant the segregation of chemical composition is.

On the other hand, it can be seen that when the uniform heating to the molten metal is in a weak state of about 600 kW, a large coagulated surface exposure distance B is produced, and the molten metal becomes in a coagulated state in the vicinity of the periphery of the opening of the water-cooled copper mold 3. When a molten metal surface is thus coagulated, it becomes difficult to continuously withdraw and produce an ingot. On the other hand, the depth of the molten metal pool is small, which is advantageous to avoid segregation of chemical composition (see FIG. 6).

The rotation torches of the present embodiment are capable of achieving a condition similar to the condition of 2,000 kW uniform heating to the melt surface. That is, it achieves a condition preferred for the continuous casting, in which the coagulated surface exposure distance of the molten metal is small, and the molten metal presents in a molten state in the vicinity of the periphery of the opening of the water-cooled copper mold 3. Moreover, the molten metal pool has a medium depth, which is an advantageous condition to suppress an occurrence of segregation of chemical composition.

Further, the inventors of the present invention have also found information that the rotation torches of the present embodiment require only a very small quantity of heat input to the molten metal.

FIG. 3 shows distributions of quantity of heat input to the molten metal by the uniform heatings and by the rotation torches individually in the conditions of the molten metal pool of FIG. 4. As can be seen from FIG. 3, while the quantity of heat input per unit area is 1.06 $MW/m^2$ with respect to a surface area in Comparative Example which performs the uniform heating (2,000 kW), a required quantity of heat input to the melt surface 6 is only about 1/3 in the rotation torches according to the present embodiment, which allows a significant reduction of the amount of energy applied to the molten metal.

Figure 5:
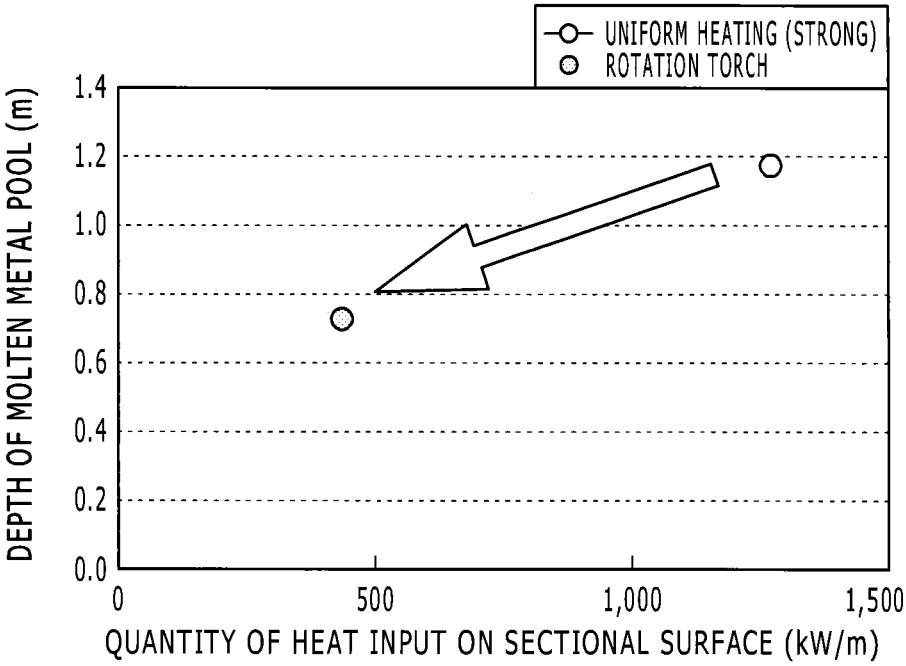
FIG. 5 is a graph showing a relationship between sectional heat input amount to the molten metal and depth of the molten metal pool.
Figure 6:
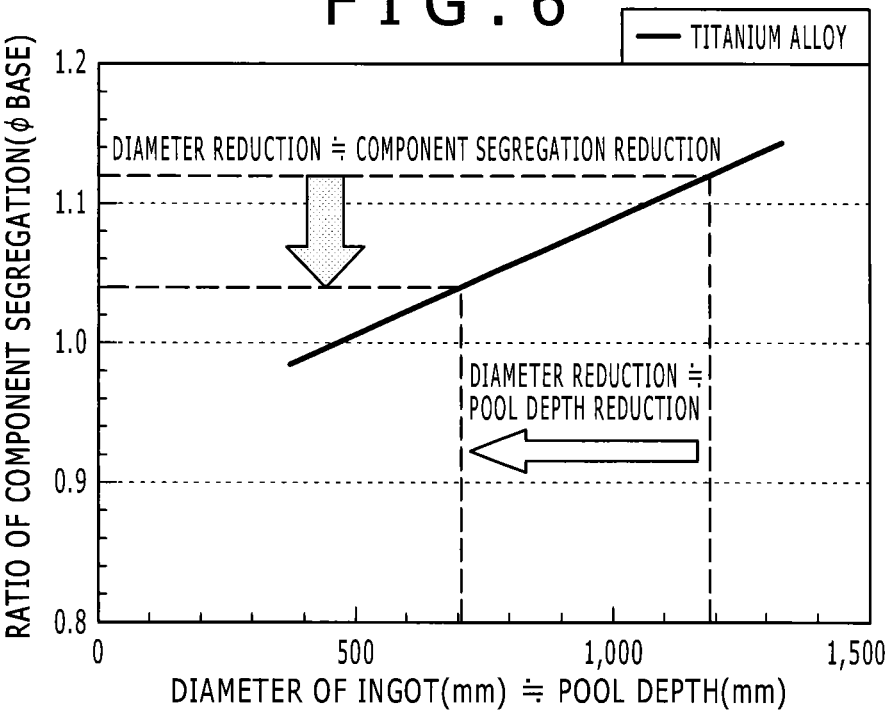
FIG. 6 is a graph showing ratio of segregation of chemical composition to the depth of the molten metal pool.

FIG. 5 and the following Table 1 summarize the information found in FIG. 3 and FIG. 4. As shown in them, use of the rotating torch allows achieving a small depth of a molten metal pool compared to that achieved by a uniform heating (strong), with a small quantity of heat input. Naturally, no coagulated part presents on the molten metal surface, and it is considered to be suitable for a casting of titanium alloy ingot.

TABLE 1

| | Heat input on sectional surface kW/m | Pool depth m |
|---|---|---|
| Uniform heating (strong) | 1273 | 1.17 |
| Uniform heating (weak) | 360 | 0.29 |
| Rotating torch | 438 | 0.72 |

To summarize the above, by selectively increasing a quantity of heating in the region in the outer circumferential portion relatively to the central portion of a molten metal, it is possible to control the segregation of chemical composition to be a conventional level, even in a case of a titanium alloy ingot having a large diameter over the conventional diameter of ϕ800 mm.

In particular, in a titanium alloy ingot, if it is possible to halve the segregation of chemical composition along the direction of withdrawing an ingot by controlling depth and shape of the molten metal pool, the β transformation point can be shifted to a higher side, which allows a temperature of a heat treatment for an improvement or an expression of a mechanical property to be raised. For example, there is a possibility that a fatigue strength can be stabilized at a high level. Thus, the rotation torches of the present embodiment are considered to be suitable for casting of titanium alloy ingot.

Finally, as already mentioned, it is possible to bring the shape of the molten metal pool close to a trapezoidal shape in which the bottom of the molten metal pool is flat, not to the downwardly convex shape as shown in FIG. 4, by imparting an external magnetic field to the molten metal by disposing electromagnetic stirring devices 9 constituted of an electromagnetic coil or the like on peripheral part of the water-cooled copper mold 3 shown in FIG. 2A and FIG. 2B, to thereby circulate and stir the outer circumferential portion of the molten metal. Since it is possible in this manner to further reduce the segregation of chemical composition in the circumferential direction (namely, the radial direction) of the titanium alloy ingot, and in addition, by the effect of segregation reduction due to the reduction of the depth of the molten metal pool, as a whole, it is possible to produce a titanium alloy ingot of a higher quality.

Incidentally, the embodiment disclosed herein should be understood as being illustrative and not limiting in all respects. In particular, features not explicitly disclosed in the embodiments disclosed herein, such as driving conditions, operating conditions, every kinds of parameters, and dimensions, weights, or volumes of structures do not deviate from the range ordinary performed by those skilled in the art, and values easily predictable by those skilled in the art are used.

In the titanium continuous casting device 1 according to the embodiment described above, it is possible to add a larger quantity of heat to the outer circumferential portion of the melt surface 6 than a quantity of heat input to the inner circumferential portion, by increasing an output of the outer circumferential portion heating torch 5 which is disposed above the melt surface 6 in the outer circumferential portion of the upper opening 3*a* to be larger than the output of the central portion heating torch 4 which is disposed above the melt surface 6 in the central portion of the upper opening 3*a*. However, the heating torches are not limited to the two torches of the central portion heating torch 4 and the outer circumferential portion heating torch 5 having outputs different from each other. For example, it is possible to add a larger quantity of heat input to the outer circumferential portion of the melt surface than a quantity of heat input to the inner circumferential portion, also in a mode which is provided with plural heating torches having the same outputs with one other, in which number of the heating torches which act as the outer circumferential portion heating torches is larger than number of the heating torches which act as the central portion heating torches.

That is, it is possible to variously devise the number and arrangement of the heating torches to be used, within a range satisfying the condition that a larger quantity of heat is added to the melt surface which presents in outer circumferential portion than an amount of the heat input to the melt surface present in the central portion.

As in the above, the present invention provides a titanium continuous casting device capable of suppressing segregation of chemical composition of the ingot, even in a case that a titanium ingot or titanium alloy ingot having a large diameter is continuously casted.

The first titanium continuous casting device provided by the present invention comprises a mold which comprises an upper section comprising a circular upper opening for pouring in molten metal of titanium or a titanium alloy, and a bottom section comprising a lower opening for continuously withdrawing an ingot of the titanium or the titanium alloy; a first and a second plasma arc irradiation unit each being disposed so as to face to the upper opening of the mold and to irradiate the upper opening of the mold with plasma arc; and a driving device which rotates at least the second plasma arc irradiation unit around the center of the upper opening of the mold. The first plasma arc irradiation unit is disposed nearer to the center of the upper opening than the second plasma arc irradiation unit is disposed.

By this device, it is possible to uniformize the heating of a molten metal by the combination of the first and the second plasma arc irradiation units and the rotation of at least the second plasma arc irradiation unit, and to thereby suppress the segregation of chemical composition of a titanium ingot or a titanium alloy ingot.

It is preferred that the first plasma arc irradiation unit is disposed in a position deviated from the center of the upper opening of the mold when the titanium continuous casting device is viewed from the side of the upper opening of the mold, and that the driving device rotates the first and second plasma arc irradiation unit around the center of the upper opening of the mold. By rotating the first plasma irradiation unit in addition to the second plasma arc irradiation unit in this manner, more uniform heating of the molten metal is achieved.

It is more preferred that the first and second plasma arc irradiation units are disposed in positions on the same straight line passing the center of the upper opening of the mold when the titanium continuous casting device is viewed from the side of the upper opening of said mold, oppositely to each other sandwiching the center, and that the driving device rotates the first and second plasma arc irradiation units in a same direction. Such arrangement of the first and second plasma arc irradiation unit is capable of further enhancing the uniformity of the heating of the molten metal by the rotation of the both plasma arc irradiation units.

It is also preferred that the plasma arc output of the second plasma arc irradiation unit is larger than the plasma arc output of the first plasma arc irradiation unit. Thus, the outputs of the plasma irradiation units are set suitably to the sizes of the regions to be heated which are allotted to the each plasma arc irradiation unit.

Specifically, it is preferred that the first and second plasma arc irradiation units are the first and second plasma torches respectively, and plasma arc output of the second plasma torch is larger than plasma arc output of the first plasma torch; or that the first plasma arc irradiation unit comprises at least one plasma torch, and the second plasma arc irradiation unit comprises plural plasma torches of a larger number than the number of the plasma torch of the first plasma arc irradiation unit.

Alternatively, the first plasma arc irradiation unit may be disposed so as to overlap the center of the upper opening of the mold when the titanium continuous casting device is viewed from the side of the upper opening of the mold.

The second titanium continuous casting device provided by the present invention comprises a mold which comprises an upper section comprising a circular upper opening for pouring in molten metal of titanium or a titanium alloy, and a bottom section comprising a lower opening for continuously withdrawing an ingot of the titanium or the titanium alloy; and a plural plasma torches which heat molten metal in the mold from a side of the upper opening of the mold by using plasma arc. The plural plasma torches are disposed such that a quantity of heat input to the molten metal present in the outer circumferential portion surrounding the central portion of the upper opening is large relative to a quantity of heat input to the molten metal present in the central portion of the upper opening.

By the device, even in a case of a titanium ingot or a titanium alloy ingot having a large diameter, it is possible to suppress a segregation of chemical composition of the ingot.

In the present invention, it is possible to appropriately set the central portion and the outer circumferential portion of the upper opening. For example, when r represents the radius of the upper opening, the central portion of the upper opening may be defined as a portion of a region within radius r/3 from the center of the upper opening, and the outer circumferential portion of the upper opening may be defined as a portion of a region within radius r/3 to r.

It is preferred that the plural plasma torches are disposed in positions different from each other with respect to the radial direction of the upper opening, and that the plural plasma torches comprise plural rotation torches which are rotatable around the center of the upper opening. The rotations of these rotation torches make it possible to significantly broaden the melt range which can be directly heated by the plasma torches.

It is preferred that the plural plasma torches comprise a first plasma torch disposed above the central portion of the upper opening and a second plasma torch disposed above the outer circumferential portion of the upper opening, and output of the second plasma torch is larger than output of the first plasma torch.

The invention claimed is:

1. A titanium continuous casting device comprising a mold which comprises an upper section comprising a circular upper opening for pouring in a molten metal of titanium or a titanium alloy, and a bottom section comprising a lower opening for continuously withdrawing an ingot of the titanium or the titanium alloy;

a first and a second plasma arc irradiation units each being disposed so as to be faced to the upper opening of said mold and to irradiate the upper opening of said mold with a plasma arc; and a driving device which rotates at least said second plasma arc irradiation unit around a center of the upper opening of said mold, wherein said first plasma arc irradiation unit is disposed nearer to the center of said upper opening than said second plasma arc irradiation unit is disposed, wherein said first plasma arc irradiation unit is disposed in a position deviated from the center of the upper opening of said mold when the titanium continuous casting device is viewed from the side of the upper opening of said mold, and said driving device rotates said first and said second plasma arc irradiation units around the center of the upper opening of said mold.

2. The titanium continuous casting device according to claim 1, wherein said first and said second plasma arc irradiation units are disposed in positions on a same straight line passing the center of the upper opening of said mold when the titanium continuous casting device is viewed from the side of the upper opening of said mold, oppositely to each other sandwiching said center, and said driving device rotates the first and the second plasma arc irradiation units in a same direction.

3. The titanium continuous casting device according to claim 1, wherein a plasma arc output of said second plasma arc irradiation unit is larger than a plasma arc output of said first plasma arc irradiation unit.

4. The titanium continuous casting device according to claim 3, wherein said first and said second plasma arc irradiation units are a first and a second plasma torches respectively, and a plasma arc output of said second plasma torch is larger than a plasma arc output of said first plasma torch.

5. The titanium continuous casting device according to claim 3, wherein said first plasma arc irradiation unit comprises at least one plasma torch, and said second plasma arc irradiation unit comprises plural plasma torches of a larger number than the number of the plasma torch of said first plasma arc irradiation unit.

6. A titanium continuous casting device comprising a mold which comprises an upper section comprising a circular upper opening for pouring in a molten metal of titanium or a titanium alloy, and a bottom section having a lower opening for continuously withdrawing an ingot of the titanium or the titanium alloy;

plural plasma torches which heat the molten metal in said mold from the side of the upper opening of said mold by using a plasma arc, wherein said plural plasma torches are disposed such that a quantity of heat input to the molten metal present in an outer circumferential portion surrounding a central portion of said upper opening becomes large compared to a quantity of heat input to the molten metal present in the central portion of said upper opening, wherein a first plasma torch is disposed nearer to the center of said upper opening than a second plasma torch is disposed, and in a position deviated from a center of the upper opening of said mold when the titanium continuous casting device is viewed from the side of the upper opening of said mold, and a driving device rotates said first and said second plasma torches around the center of the upper opening of said mold.

7. The titanium continuous casting device according to claim 6, wherein the central portion of the upper opening is a portion of a region within radius r/3 from the center of said upper opening, and the outer circumferential portion of said upper opening is a portion of a region of radius r/3 to r from the center of said upper opening, when r represents a radius of said upper opening.

8. The titanium continuous casting device according to claim 6, wherein said plural plasma torches comprise plural rotation torches which are disposed in positions different from one another in a radial direction of said upper opening, rotatably around the center of said upper opening.

9. The titanium continuous casting device according to claim 6, wherein said plural plasma torches comprise a first plasma torch disposed above the central portion of said upper opening and a second plasma torch disposed above the outer circumferential portion of said upper opening, and an output of said second plasma torch is larger than an output of said first plasma torch.

* * * * *